US006692333B2

(12) United States Patent
Kislevitz et al.

(10) Patent No.: US 6,692,333 B2
(45) Date of Patent: Feb. 17, 2004

(54) TOY VEHICLE

(75) Inventors: Androc L. Kislevitz, Ridgewood, NY (US); Adam L. Kislevitz, Englewood, NJ (US); Noah L. Kislevitz, Cresskill, NJ (US); Justin M. Discoe, Merchantville, NJ (US); David V. Helmlinger, Mt. Laurel, NJ (US); David J. Ribbe, Mahomet, IL (US)

(73) Assignee: The Obb, LLC, Englewood, NJ (US)

( * ) Notice: Subject to any disclaimer, the term of this patent is extended or adjusted under 35 U.S.C. 154(b) by 0 days.

(21) Appl. No.: 10/377,564

(22) Filed: Feb. 28, 2003

(65) Prior Publication Data

US 2003/0224695 A1 Dec. 4, 2003

Related U.S. Application Data

(60) Provisional application No. 60/384,477, filed on May 31, 2002.

(51) Int. Cl.[7] ..... A63H 17/00; A63H 30/00

(52) U.S. Cl. ..... 446/437; 446/454

(58) Field of Search ..... 446/427, 428, 446/431, 432, 434, 437, 454, 457, 460–470, 93–96

(56) References Cited

U.S. PATENT DOCUMENTS

| | | | |
|---|---|---|---|
| 1,581,688 | A | 4/1926 | Pehrson |
| 1,948,744 | A | 2/1934 | Curtiss |
| 2,026,181 | A | 12/1935 | Kennedy |
| 2,209,457 | A | 7/1940 | Hare |
| 2,216,497 | A | 10/1940 | McHenry |
| 2,398,541 | A | 4/1946 | Leach |
| 2,784,527 | A | 3/1957 | Sarff |
| 2,836,254 | A | 5/1958 | Boehner |
| 3,406,480 | A | 10/1968 | Joffe |
| 3,619,940 | A | 11/1971 | Good et al. |

(List continued on next page.)

FOREIGN PATENT DOCUMENTS

| | | |
|---|---|---|
| DE | 879 071 | 6/1953 |
| DE | 3240712 A1 | 5/1984 |
| EP | 0 694 323 A1 | 1/1996 |
| GB | 472946 A | 10/1937 |
| GB | 967429 A | 8/1964 |
| GB | 1 278 082 A | 6/1972 |
| GB | 2 087 739 A | 6/1982 |
| GB | 2 130 904 A | 6/1984 |
| GB | 2 139 104 A | 11/1984 |
| GB | 2 215 626 A | 9/1989 |
| GB | 2 227 679 A | 8/1990 |

OTHER PUBLICATIONS

Eric Schine; "Mattel's Wild Race To Market", Business Week (magazine), Feb. 21, 1994, pp. 62–63, U.S.A.

*Primary Examiner*—Jacob K. Ackun
*Assistant Examiner*—Faye Francis
(74) *Attorney, Agent, or Firm*—Akin Gump Strauss Hauer & Feld, LLP

(57) ABSTRACT

A toy vehicle has front and rear chassis portions and a flipping mechanism which allows the front chassis portion to rotate 360 degrees with respect to the rear chassis portion about a longitudinal axis. The flipping mechanism includes a triggering mechanism, a rotational drive mechanism and a mechanism to prevent damage to a main spring which drives the rotational motion of the front chassis relative to the rear chassis. The toy vehicle may be remote controlled, and include a remote control transmitter. One remote control transmitter includes a left hand and a right hand portion, with the two portions being pivotable with respect to one another to activatea control switch.

10 Claims, 10 Drawing Sheets

U.S. PATENT DOCUMENTS

| | | | | | |
|---|---|---|---|---|---|
| 3,813,812 | A | | 6/1974 | Barlow et al. | |
| 4,055,021 | A | | 10/1977 | Okamoto | |
| 4,135,328 | A | | 1/1979 | Yamasaki | |
| 4,156,987 | A | | 6/1979 | Lahr | |
| 4,163,341 | A | | 8/1979 | Jones et al. | |
| 4,187,637 | A | | 2/1980 | Nielsen | |
| 4,218,846 | A | | 8/1980 | Lahr | |
| 4,248,012 | A | | 2/1981 | Kirby et al. | |
| 4,254,577 | A | | 3/1981 | Cheng | |
| 4,327,519 | A | | 5/1982 | Cooper et al. | |
| 4,363,187 | A | | 12/1982 | Shinohara | |
| 4,382,599 | A | | 5/1983 | Tilbor | |
| 4,385,466 | A | | 5/1983 | ReVelle | |
| 4,415,157 | A | | 11/1983 | Lahr | |
| 4,457,101 | A | | 7/1984 | Matsushiro | |
| 4,463,520 | A | | 8/1984 | Crosman | |
| 4,522,607 | A | | 6/1985 | Kilroy et al. | |
| 4,545,776 | A | | 10/1985 | Law | |
| 4,568,306 | A | | 2/1986 | Martin | |
| 4,591,346 | A | | 5/1986 | Ikeda | |
| 4,596,534 | A | | 6/1986 | Ishimoto | |
| 4,655,724 | A | | 4/1987 | Law | |
| 4,666,420 | A | | 5/1987 | Nagano | |
| 4,691,798 | A | | 9/1987 | Engelbach | |
| 4,822,316 | A | | 4/1989 | Shaffer et al. | |
| 4,846,758 | A | | 7/1989 | Chou | |
| 4,892,502 | A | | 1/1990 | Hesse | |
| 4,894,042 | A | | 1/1990 | Kamikawa | |
| 4,902,271 | A | | 2/1990 | Yoneda | |
| 5,019,009 | A | | 5/1991 | Chao-Chin et al. | |
| 5,078,641 | A | * | 1/1992 | Chen | 446/86 |
| 5,100,368 | A | | 3/1992 | Chien | |
| 5,240,451 | A | | 8/1993 | Clark, Jr. | |
| 5,259,808 | A | | 11/1993 | Garr | |
| 5,273,480 | A | | 12/1993 | Suto | |
| 5,312,288 | A | | 5/1994 | Williams | |
| 5,334,077 | A | | 8/1994 | Bailey | |
| 5,449,311 | A | | 9/1995 | Williams | |
| 5,609,510 | A | | 3/1997 | Stubenfoll et al. | |
| 5,709,583 | A | | 1/1998 | Suto et al. | |
| 5,727,986 | A | | 3/1998 | Stubenfoll et al. | |
| 5,842,907 | A | | 12/1998 | Niimura et al. | |
| 5,882,241 | A | | 3/1999 | Mullaney et al. | |
| 6,039,626 | A | * | 3/2000 | Gerold et al. | 446/175 |
| 6,106,362 | A | * | 8/2000 | Keller et al. | 446/456 |
| 6,394,876 | B1 | * | 5/2002 | Ishimoto | 446/428 |
| 2001/0004578 | A1 | | 6/2001 | Jaffe | |

* cited by examiner

TOY VEHICLE

CROSS-REFERENCE TO RELATED APPLICATIONS

This application claims benefit of U.S. Provisional Patent Application 60/384,477, "Toy Vehicle", filed May 31, 2002, the subject matter of which is incorporated herein by reference.

BACKGROUND OF THE INVENTION

The present invention relates generally to toy vehicles and, more particularly, to remote control toy vehicles that flip over upon activation of a spring-loaded flipping mechanism.

A variety of toy vehicles are known which include a mechanism for upsetting or overturning the vehicle during normal operation. Toy manufacturers have found that vehicles that include a flipping mechanism are a more dynamic and entertaining toy and provide increased play value.

Known toy vehicles typically include a flipping member that extends from the toy vehicle and rotates to contact a supporting surface to overturn the vehicle. It is believed that a new toy vehicle design having an unusual flipping action would be desirable and provide enhanced entertainment value.

BRIEF SUMMARY OF THE INVENTION

According to one aspect of the invention, a toy vehicle is provided comprising a vehicle body having a front portion and a rear portion and a longitudinal axis extending through the front and rear portions. At least one rear wheel is coupled with the rear portion and located on the vehicle so as to at least partially support the rear portion. A first electric motor is drivingly coupled with the at least one rear wheel. At least one front wheel is coupled with the front portion and located on the vehicle so as to at least partially support the front portion. An electrically operated steering actuator is mounted on the front portion and drivingly coupled to the at least one front wheel to rotate the at least one wheel to steer the toy vehicle. A spring-loaded flipping mechanism rotatably couples the front and rear portions together so as to selectively flip the front portion of the vehicle body at least 360° with respect to the rear portion of the vehicle body about the longitudinal axis.

According to a further aspect of the invention a remote control device is provided for a toy vehicle in combination with a handheld remote controller having a multi-part housing, wherein at least two of the housing parts are pivotable with respect to each other to control an operation of the toy vehicle.

BRIEF DESCRIPTION OF THE SEVERAL VIEWS OF THE DRAWINGS

The foregoing summary as well as the following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
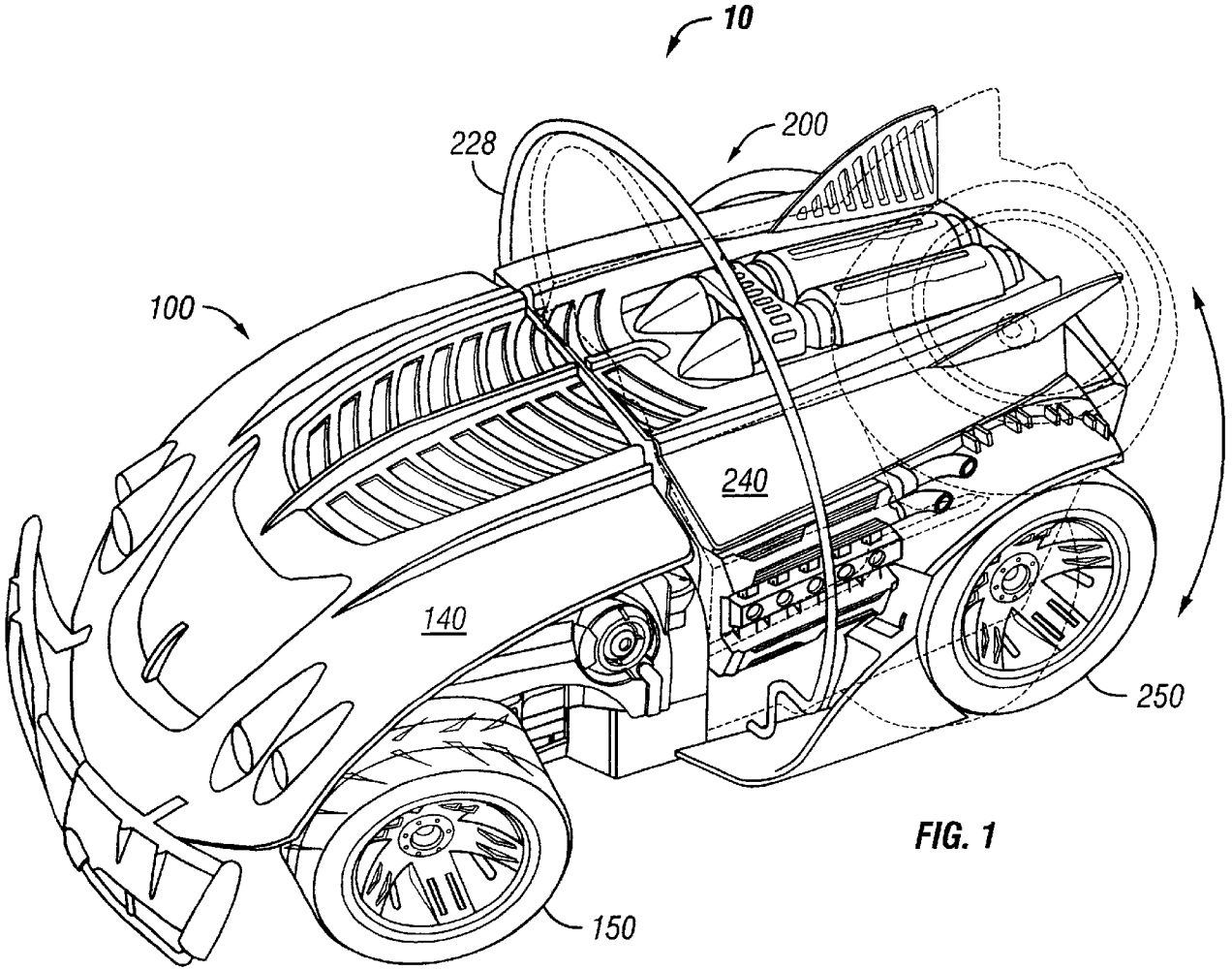
FIG. 1 is a front perspective view of one embodiment of the toy vehicle of the present invention.

Certain terminology is used in the following description for convenience only and is not limiting. The words "lower" and "upper" designate directions in the drawings to which reference is made. The words "inwardly" and "outwardly" refer to directions toward and away from, respectively, the geometric center of the vehicle and designated parts thereof. The word "a" is defined to mean "at least one". The terminology includes the words above specifically mentioned, derivatives thereof and words of similar import. In the drawings, like numerals are used to indicate like elements throughout.

Referring to the drawings and particularly to FIGS. 1–10, a preferred embodiment of the toy vehicle 10 of the present invention is disclosed. The vehicle 10 includes a front chassis portion 100 (also referred to herein as "front chassis 100") and a rear chassis portion 200 (also referred to herein as "rear chassis 200").

Figure 6:
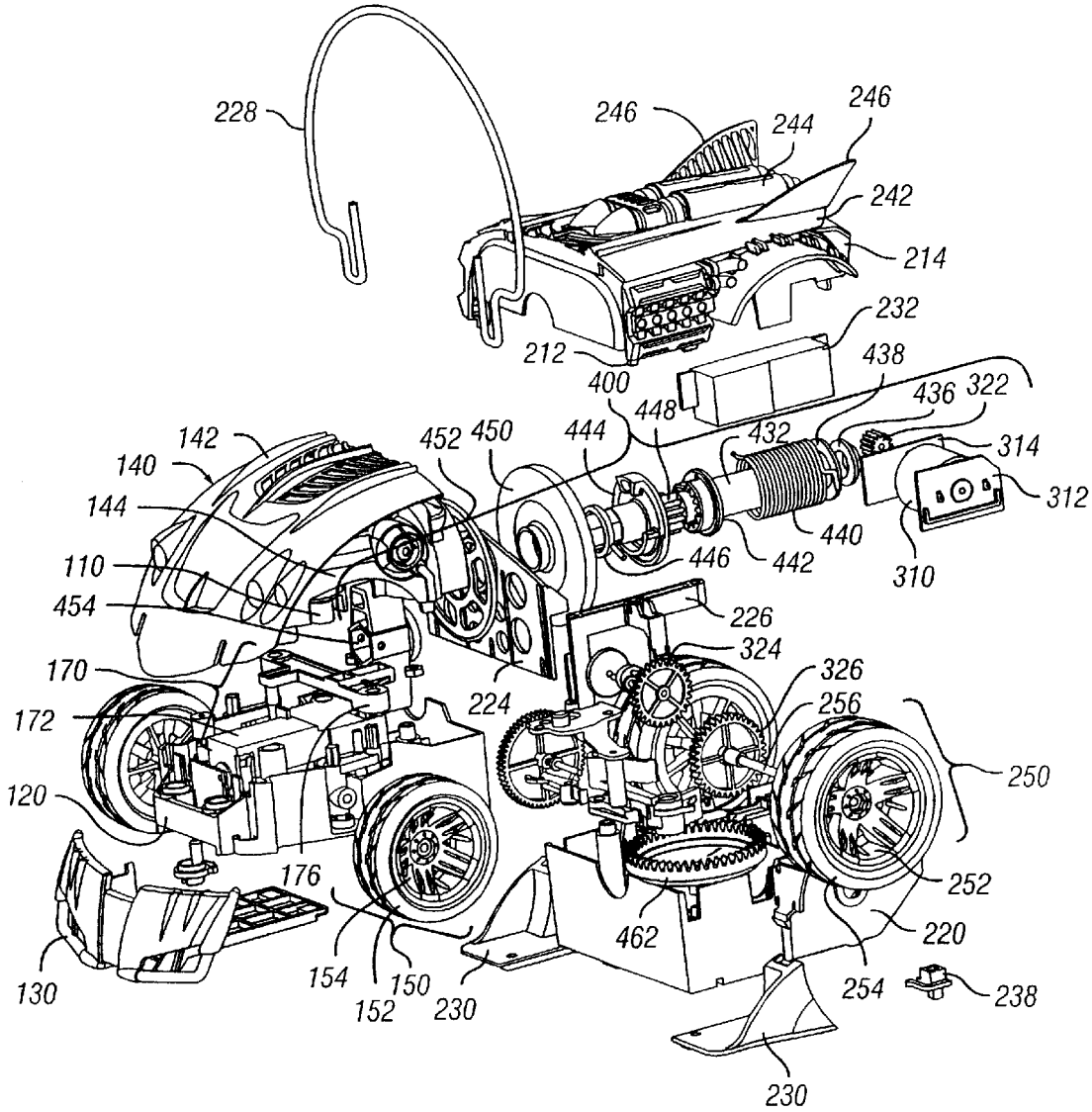
FIG. 6 is an exploded view of the toy vehicle of FIG. 1.

Referring to FIG. 6, the front chassis 100 comprises a first top housing plate 110 and a first bottom housing plate 120. A front body 140, which includes a hood 142 and fenders 144 is mounted to the first top housing plate 110. The first bottom housing plate 120 contains a steering assembly 170, and supports a front bumper 130 and at least one and preferably two front wheel assemblies 150. The first bottom housing plate 120 further includes a first battery box 122, a second battery box 124 (see FIG. 2). The first and second battery boxes, 122, 124 are accessible from the bottom of the first bottom housing plate 120 via first and second battery box doors 126, 128, respectively.

The front wheel assemblies 150 each include a wheel hub 152 and a tire 154 (see FIG. 6). The hub is attached to a support arm 156. The support arms 156 include a top support pin 158 and a bottom support pin 160. The support arms 156 further include a steering pivot pin 162.

Figure 3:
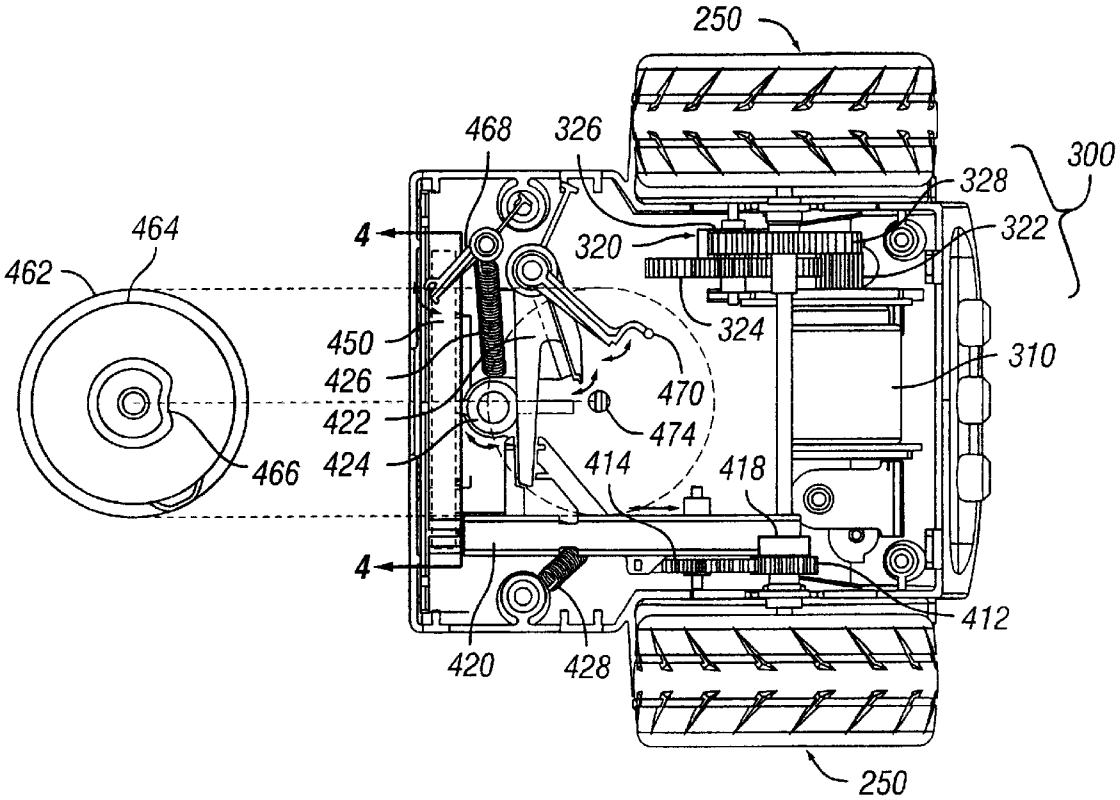
FIG. 3 is a top plan view of the toy vehicle of FIG. 1, partially disassembled to show interrelation of some components of a flipping mechanism.

The steering assembly 170 is coupled to the wheel assemblies 150 to provide powered steering control. The steering assembly 170 is preferably a conventional design that includes a motor, a slip clutch and a steering gear box, all of which are contained within motor and gear box housing 172. A steering actuating lever 174 extends upward from the motor and gear box housing 172, and moves from left to right. The steering actuating lever 174 fits within a receptacle 175 in a tie rod 176. The tie rod 176 is provided with holes 178 at each opposing end. The steering pivot pins 162 fit within the holes 178. As the tie rod 176 moves left and right under the action of the steering actuating lever 174 the front wheel assemblies 150 are caused to turn as support arms 156 are pivoted by steering pivot pins 162. The position of the tie rod 176 is adjustable by a steering trim mechanism 180. The steering trim mechanism is adjustable by a steering trim adjustment screw 182, located on the bottom of the vehicle 10, as is illustrated in FIG. 3. One of ordinary skill will appreciate that any know steering assembly can be used with the present invention to provide steering control of the toy vehicle 10.

Figure 4:
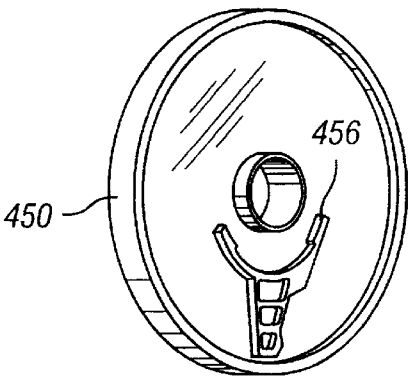
FIG. 4 is an rear perspective view of a shaft disk of the toy vehicle of FIG. 1.

The rear chassis 200 includes a second top housing plate 210 and a second bottom housing plate 220. As seen in FIG. 4, attached to the second top housing plate 210 are ornamental engines 212 and a rear bumper 214. A second top cover assembly 240 is preferably also attached to the second top housing plate 210. The second top cover assembly 240 includes a mounting plate 242, to which is attached ornamental rockets 244 and fins 246.

The rear chassis 200 further includes a second bottom housing plate 220. The second bottom housing plate 220 contains a linear drive assembly 300 and components of the flipping mechanism assembly 400. Sub-assemblies of the flipping mechanism 400 include a triggering mechanism sub-assembly 410, a rotational drive mechanism sub-assembly 430 and a spring protection mechanism sub-assembly 460. One or more rear wheel assemblies 250 are mounted to an axle 256, and mounted for rotation on the second bottom housing plate 220.

The second bottom housing plate 220 includes a drive shaft aft support member 222, a drive shaft forward support member 224, a spring support member 226, a rollbar 228, and a pair of wings 230 which are affixed to the underside of the second bottom housing plate 220 adjacent the rear wheel assemblies 250. A circuit board 232 containing the device electronics is supported on its aft end by a receptacle 234 formed into the second bottom housing plate 220 and is supported at the forward end by a receptacle 236 formed in the spring support member 226. An on/off switch 238 is accessible from the underside of the second bottom housing plate 220.

The roll bar 228 preferably serves to protect the toy vehicle 110 from ground contact during flipping. The roll bar 228 also serves to help the toy vehicle 10 right itself when overturned. Preferably, the roll bar 228 is made of metal or other suitable material and serves as an antenna. The roll bar/antenna 228 is preferably coupled to circuit board 232 and is capable of receiving and/or transmitting signals between a remote controller (discussed below) and the circuit board 232 to control operation of the toy vehicle 10.

Figure 2:
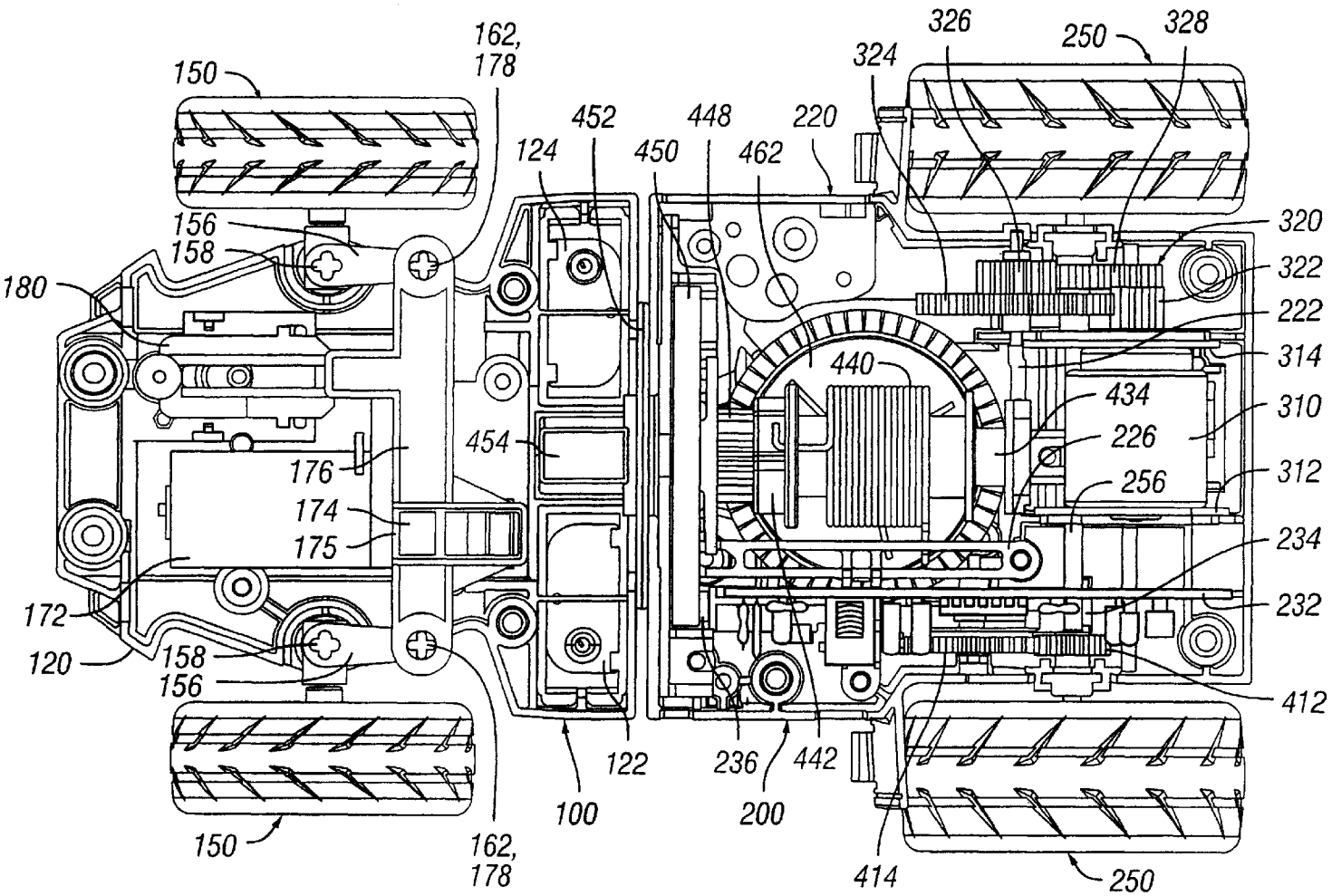
FIG. 2 is a top plan view of the toy vehicle of FIG. 1, with the body sections removed.
Figure 5:
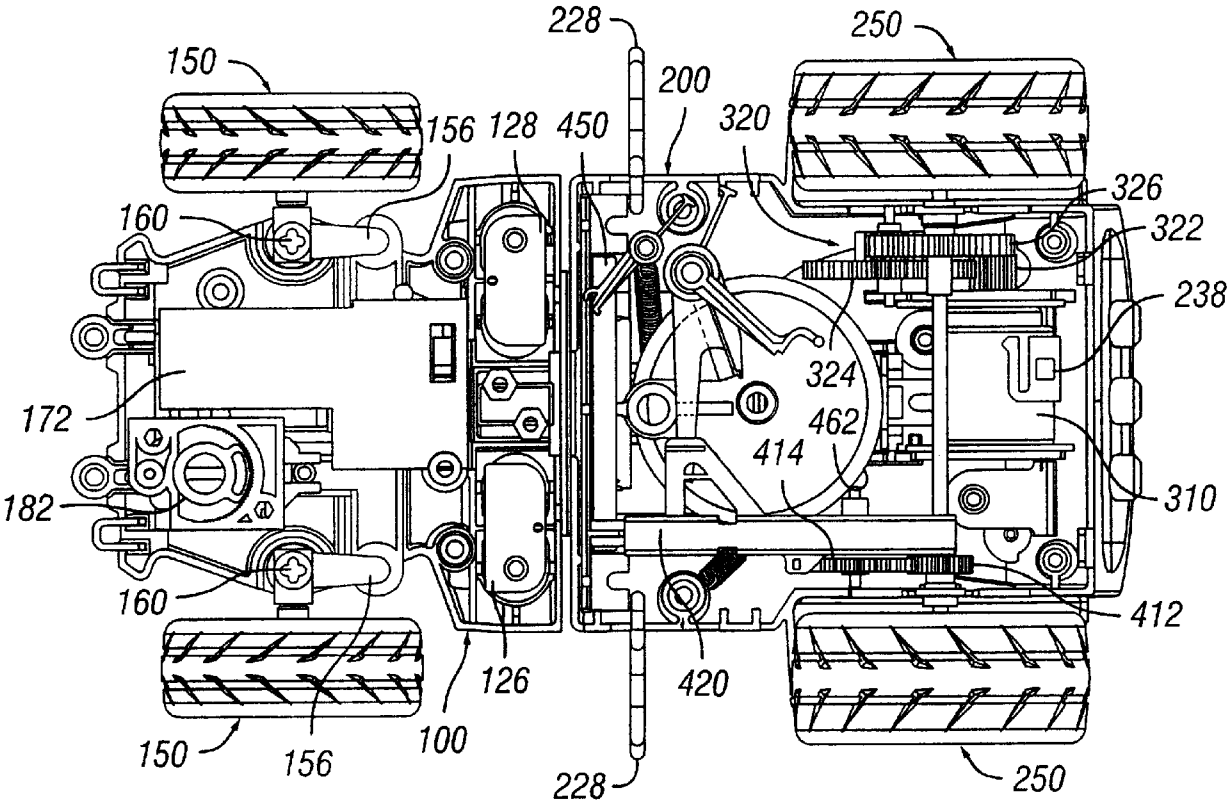
FIG. 5 is a bottom plan view of the embodiment of FIG. 1, with bottom panels of the chassis removed.

The linear drive assembly 300 includes a drive motor 310. With particular reference to FIGS. 2 and 5, the drive motor 310 is preferably mounted on opposite ends to a first motor mount plate 312 and a second mount plate 314. The drive motor 310 is preferably a reversible electric motor of the type generally used in toy vehicles. The motor 310 is operably coupled to the axle 256 through a drive gear train 320. The drive gear train 320 includes a pinion 322 affixed to an output shaft (not shown) of the drive motor 310. The pinion 322 engages a combined reduction gear 324 with integral spur gear 326, the spur gear 326 in engagement with a drive gear 328 fixedly attached to the axle 256. The motor 310 can thus drive the rear wheel assemblies 250 through the drive gear train 320 in either a forward or reverse direction. Other drive train arrangements could be used such as belts or other forms of power transmission. The arrangements disclosed herein are not meant to be limiting.

A spring-loaded flipping mechanism, generally indicated as 400, is mounted to the toy vehicle 10. The flipping mechanism 400 is operably coupled to both the front chassis 100 and the rear chassis 200. When actuated, the flipping mechanism 400 flips or rotates the front chassis 100 360° with respect to the rear-chassis 200 about a longitudinal axis 434 of the toy vehicle 10.

In the preferred embodiment-shown in the FIGS. 1–10, the flipping mechanism 400 includes three sub-assemblies: a triggering mechanism 410, a rotational drive mechanism 430 and a spring protection mechanism 460.

Figure 8:
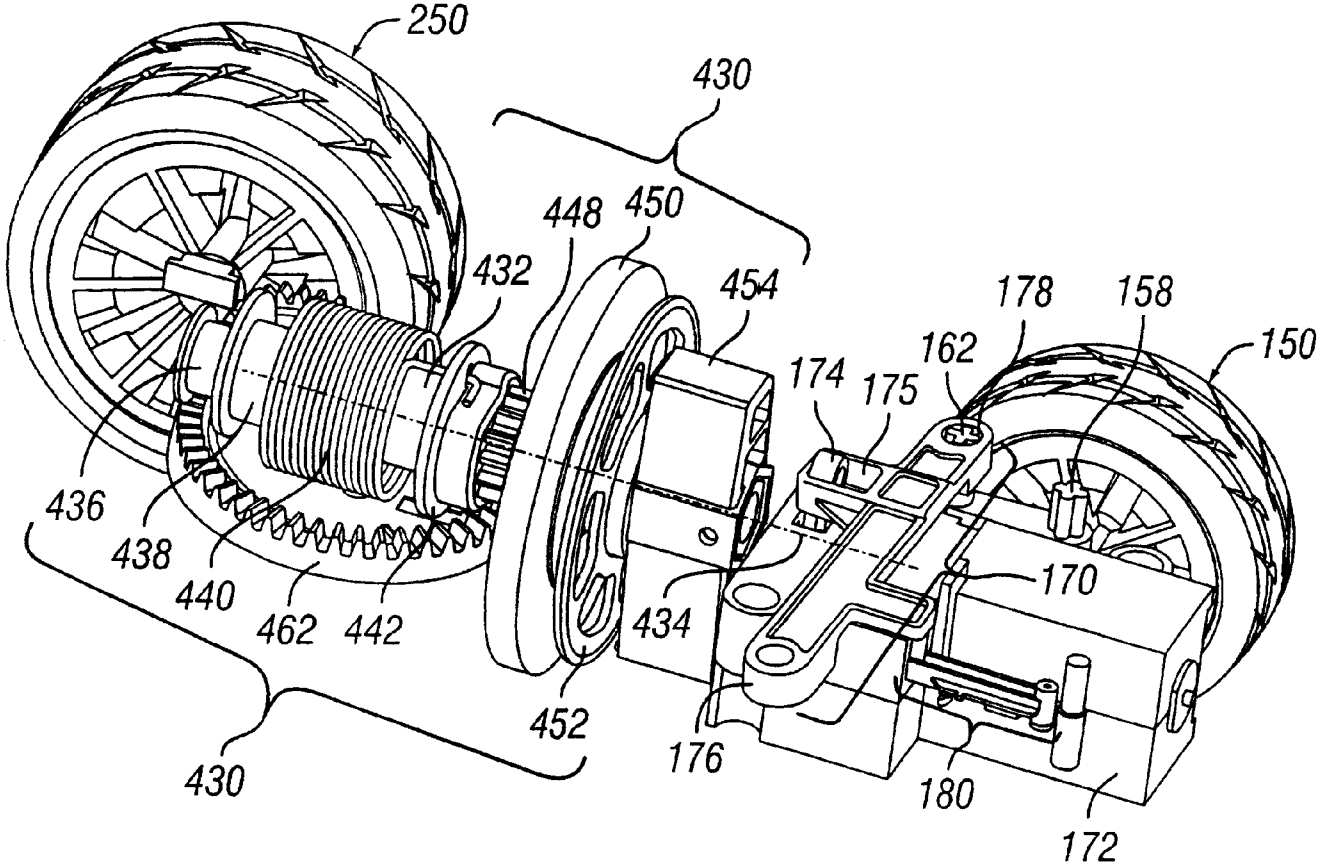
FIG. 8 is a side perspective view of the rotational drive mechanism sub-assembly of the flipping mechanism and of the steering assembly of the toy vehicle of FIG. 1.

With particular reference to FIGS. 6 and 8, the rotational drive mechanism 430 includes a main drive shaft 432, with a longitudinal axis 434. The main shaft 432 is supported at the aft end by a main shaft aft bushing 436, which connects to the second bottom housing plate 220 though main shaft aft support member 222. A main spring 440 surrounds a portion of the main shaft 432. The main spring 440 is preferably a torsion spring comprising a plurality of spring wire turns. The main spring 440 is preferably pre-loaded (e.g. twisted about 2–3 times) to provide a minimum or starting torque on the main shaft 432. The pre-load on the main spring 440 allows the main spring 440 to unload in a substantially linear fashion (i.e. providing a substantially linear force on the main shaft 432) when the flipping mechanism 400 is actuated. A substantially linear force from the main spring 440 provides a relatively consistent flipping action when the flipping mechanism 400 is actuated.

A main shaft bushing 438 is preferably sleeved around the main shaft 432 between the main spring 440 and the main shaft 432. The main shaft bushing 438 prevents the main spring 440 from rubbing on the main shaft 432 and causing undue wear of the main shaft 432 or the main spring 440. The main shaft bushing 438 also prevents the main spring 440 from binding on the main shaft 432 when the main spring 440 is loaded.

A spring holder 442 is mounted on main shaft 432 and one end of the main spring 440 is affixed to the spring holder 442. The opposite end of the main spring 440 is preferably supported by the spring support member 226 to maintain the torsion on the main spring 440.

Abutting the spring holder 442 is a winding gear 448, which is fixedly attached to the main shaft 432. The winding gear 448 is formed integrally with a winding gear base 444. Portions of the winding gear base 444 abut a shaft disk 450, with a torsion damper spring 446 coiled about the main shaft 432 disposed between the winding gear base 444 and the shaft disk 450.

As seen particularly in FIG. 4, the shaft disk 450 is provided with a raised element which forms a shaft disk stop 456 on the rear face of the shaft disk 450. As described later herein, this protruding shaft disk stop 456 interacts with a stopper member 424 and an over-wind prevention arm 468, as part of the functioning of the triggering mechanism 410 and the spring protection mechanism, respectively.

A chassis alignment disk 452 is preferably mounted on the main shaft 432 between the front chassis 100 and the rear chassis 200. The chassis alignment disk 452 maintains axial alignment of the front and rear chassis portions 100, 200. Maintaining axial alignment of the front and rear chassis portions 100, 200 prevents the front chassis 100 from contacting the rear chassis 200 when the front chassis 100 rotates about the longitudinal axis 434 of the toy vehicle 10 and the main shaft 432.

The main shaft 432 preferably extends forward from the rear chassis 200 and is received in a pivot block 454. The pivot block 454 contacts both the first top housing plate 110 and the first bottom housing plate 120 of the front chassis 100 to couple the front chassis 100 to the main shaft 432. Preferably, the pivot block 454 can rotate between about 0–15° (+/−7.5°) within the front chassis 100 to account for any misalignment between the front and rear chassis portions 100, 200 when the toy vehicle 10 is not on a flat surface.

Figure 7:
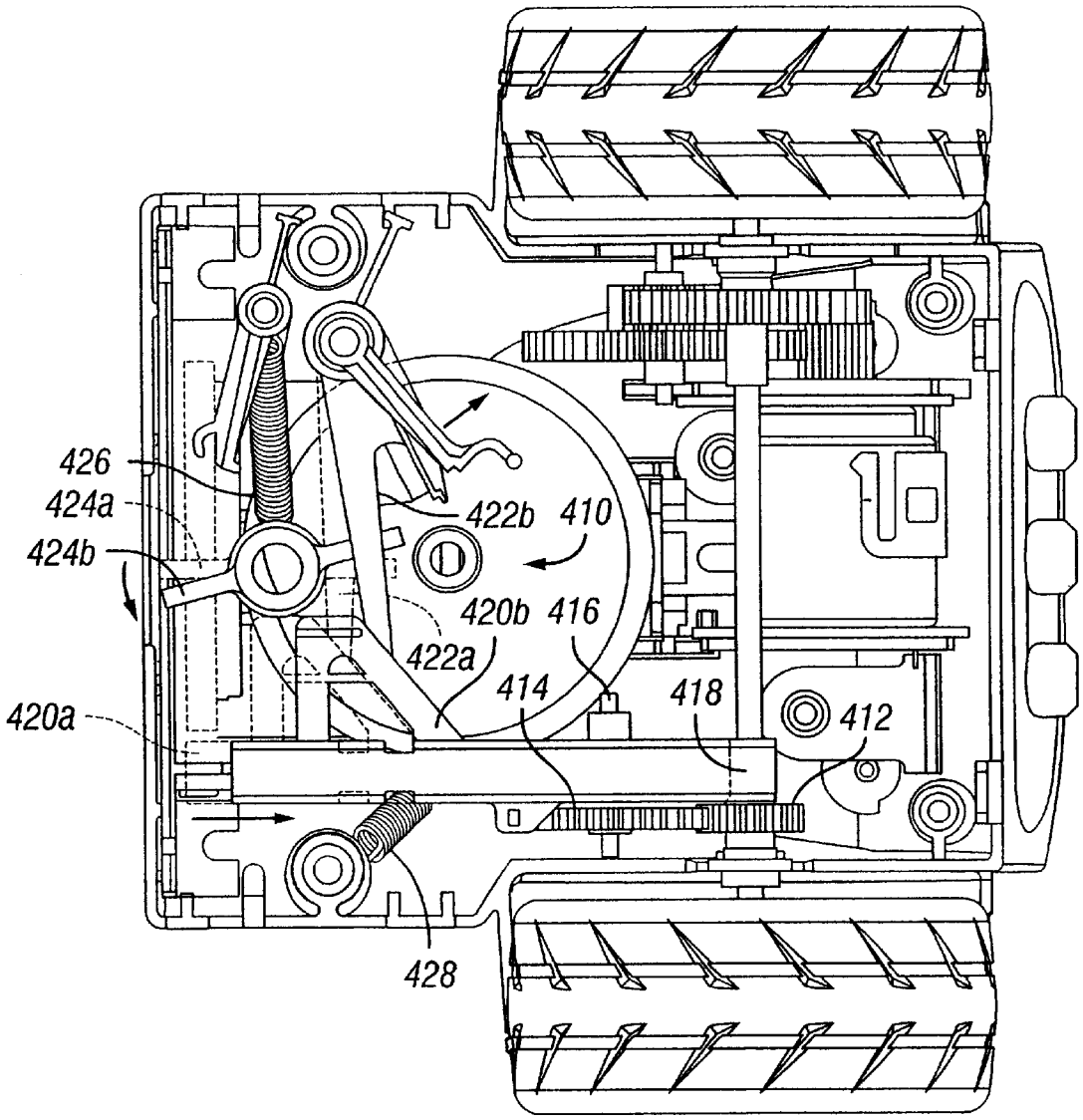
FIG. 7 is a top view of the triggering mechanism sub-assembly of the flipping mechanism assembly of the toy vehicle of FIG. 1.

With particular reference to FIGS. 3 and 7, the triggering mechanism 410 includes an axle pinion 412 fixed to the rear drive axle 256. The axle pinion 412 engages an actuator gear 414. The actuator gear 414 has an actuator gear pin 416 on an inner face that contacts an actuator trigger 418 mounted adjacent to the actuator gear 414. The actuator trigger 418 engages a spring-loaded slide plate 420. Slide plate 420 is biased into a forward position 420*a* (see FIG. 7) by spring 428. The slide plate 420 engages and pivots a first swing door member 422. In a nominal, un-triggered state, first swing door member 422 engages a stopper member 424. Further in this nominal, un-triggered state, stopper member 424 engages shaft disk stop 456 on the shaft disk 450, thus holding the shaft disk 450 (as well as other components of the rotational drive assembly 430 in position, against the tension in main spring 440. A stopper member spring 426 connects to stopper member 424. Operation of the triggering mechanism is described later herein.

Figure 9:
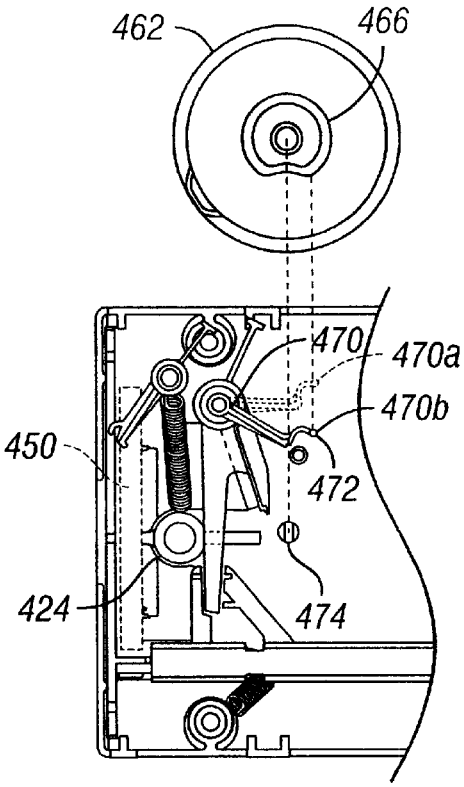
FIG. 9 is a top view of portions of the spring protection mechanism of the toy vehicle of FIG. 1.
Figure 10:
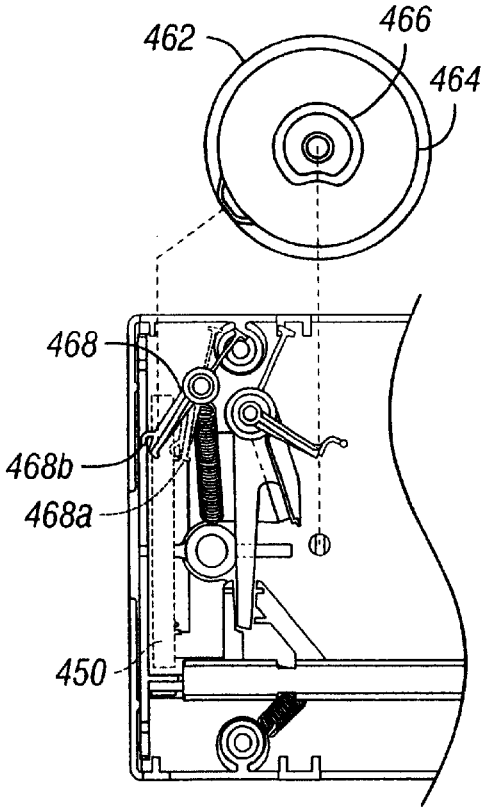
FIG. 10 is a top view of other portions of the spring protection mechanism of the toy vehicle of FIG. 1.

With particular reference to FIGS. 3, 9 and 10, the spring protection mechanism 460 includes a crown gear 462 which is in engagement with winding gear 448. The crown gear 462 includes a cam surface 464 thereon. An over-wind prevention arm 468 is preferably mounted proximate to the crown gear 462 and the shaft disk 450. As described below, the over-wind prevention arm 468 may be biased into engagement with the shaft disk stop 456, preventing further winding of the main spring 440, when the main spring 440 has been fully wound.

The spring protection mechanism 460 further includes elements to prevent the release of the pre-load placed on the main spring 440 (i.e. under-wind prevention). In a preferred embodiment, a cam groove 466 located on the underside of the crown gear 462 engages a second swing door member 470 when the crown gear 462 has rotated to a position corresponding to the pre-load condition of the main spring 440. As described below, the second swing door member 470 may be biased into engagement with stopper member 424 preventing rotation of stopper member 424 out of engagement with shaft disk stop 456, thus preventing release (and further unwinding) of the shaft disk 450.

In operation, a user manually winds the rotational drive mechanism 430 by holding the rear chassis 200 while twisting or rotating the front chassis 100 counterclockwise (aft looking fore) about the longitudinal axis 434 of the main shaft 432. Winding the rotational drive mechanism 430 loads the main spring 440. In a preferred embodiment the rotational drive mechanism 430 is designed to allow a user to wind the rotational drive mechanism 430 up to three (3) times. One of ordinary skill will appreciate that the rotational drive mechanism 430 can alternatively be designed to allow a user to wind or load the rotational drive mechanism 430 more or less than three turns. The rotational drive mechanism 430 preferably includes a tactile "click" when wound so that a user can register the number of turns which have been completed.

In a preferred embodiment, when the toy vehicle 10 is driven in reverse, the triggering mechanism 410 is actuated, releasing the shaft disk 450 and shaft disk stop 456 from engagement with stopper member 424 described above in reference to the triggering mechanism 410, and the rotational drive mechanism 430 causes the front chassis portion 100 of the toy vehicle 10 to flip or rotate approximately 360° with respect to the rear chassis portion 200 about the longitudinal axis 434 of the main shaft 432. The toy vehicle 10 preferably lands on wheels 150, 250 and can continue driving in reverse or change directions.

If the toy vehicle 10 continues to drive in reverse the triggering mechanism 410 and the rotational drive mechanism 430 will continue to flip the front chassis portion 100 until the rotational drive mechanism 430 is unloaded (i.e. the rotational drive mechanism 430 unwinds until the load on the main spring 440 reaches its pre-loaded state and the spring protection mechanism 460 prevents further unwinding, as described below). Once the rotational drive mechanism 430 is unwound the toy vehicle 10 can be driven in reverse (or in any direction) in a normal fashion (i.e. without flipping).

More particularly, the spring-loaded flipping mechanism 400 is actuated by the triggering mechanism 410 when the toy vehicle 10 is driven in reverse and the rear wheel assembly 250, the rear drive axle 256 and the axle pinion 412 rotate. Rotation of the axle pinion 412 rotates the actuator gear 414. As the actuator gear 414 is rotated the actuator gear pin 416 on the actuator gear 414 engages the actuator trigger 418 which engages and pulls back on the spring-loaded slide plate 420, moving the slide plate 420 from a first position 420*a* to a second position 420*b* (see FIG. 7). The slide plate 420 engages and pivots the first swing door member 422 rearwardly, from a first position 422*a* to a second position 422*b*. As the first swing door member 422 is pivoted rearwardly the stopper member 424 is released from engagement with the first swing door member 422. The stopper member 424 pivots from a first position 424*a* to a second position 424*b*, releasing the stopper member 424 from engagement with the shaft disk stop 456 (shown in FIG. 4) on the shaft disk 450. When the shaft disk stop 456 and the shaft disk 450 are released from engagement with the stopper member 424, the torque provided by the main spring 440 on the main shaft 432 causes the shaft disk 450, the main shaft 432, the front pivot block 454 and the front chassis 100 to flip or rotate about the longitudinal axis 434 of the main shaft 432. The stopper member spring 426 biases the stopper member 424 back toward position 424*a*, and as the shaft disk 450 rotates though one complete rotation, the stopper member 424 re-engages the shaft disk stop 456, thus stopping rotation of the rotational drive mechanism after one 360° cycle. A damper spring 446 provides a damping force or cushion such that the force on the various components of the rotational drive mechanism 430 from the torque produced by rotation of the front chassis 100 is reduced, preventing breakage of the components.

The spring protection mechanism 460 operates to prevent both over-winding and under-winding of the main spring 440. Manual winding of the front chassis 100 relative to the rear chassis 200 occurs when a user rotates the front chassis 100 relative to the rear chassis 220, causing the main shaft 432 to rotate under the action of the pivot block 454. Rotation of the main shaft 432 in turn causes rotation of the winding gear 448, which is in engagement with the crown gear 462. In the preferred embodiment, three complete manual rotations of the front chassis 100 relative to the rear chassis 200 causes rotation of the crown gear 462 to a point where the crown gear cam surface 464 engages the over-wind prevention arm 468, pushing the over-wind prevention arm 468 from a first position 468a to a second position 468b, toward the rear face of the shaft disk 450 (see particularly FIG. 10). Should a user attempt further winding of the toy vehicle 10, the over-wind protection arm 468 engages the shaft disk stop 456, preventing further winding. Thus, the main spring 440 is protected from over-winding. When the flipping mechanism 400 is actuated, the crown gear cam surface 464 rotates out of engagement with the over-wind protection arm 468, allowing the user to again wind the rotational drive mechanism 430.

The spring protection mechanism 460 further operates to prevent release of the pre-load placed on the main spring 440 (established when the toy vehicle 10 is assembled). The crown gear cam groove 466 (see particularly FIGS. 3 and 9) engages a pin 472 on the second swing door member 470. When the front chassis 100 rotates relative to the rear chassis 200, the crown gear 462 rotates under the action of the winding gear 448 on the main shaft 432. In a preferred embodiment, as the front chassis 100 rotates three cycles from a fully wound condition, the crown gear 462 rotates to a position where the second swing door 470 is moved (via movement of pin 472 moving in crown gear cam groove 466) from a first position 470*a* to a second position 470*b* (see FIG. 9). In this second position 470*b*, the second swing door 470 prevents the stopper member 424 from moving out of engagement with the shaft disk stop 456. Thus, the shaft disk 450 is prevented from rotating further, and the rotational drive mechanism 430 is prevented from further unwinding. When the rotational drive mechanism 430 is wound, the crown gear 462 rotates, and the second swing door 470 is moved out of engagement with the stopper member 424, as pin 472 follows the crown gear cam groove 466.

The vehicle 10 can be constructed of, for example, plastic or any other suitable material such as metal or composite materials. From this disclosure, it would be obvious to one skilled in the art to vary the dimensions of the toy vehicle 10 shown, for example making components of the toy vehicle smaller or larger relative to the other components. The vehicle 10 is preferably able to flip while in motion on the ground, or while in the air (e.g. while jumping off of a ramp).

The toy vehicle 10 is preferably controlled via radio (wireless) signals from a remote controller. However, other types of controllers may be used including wired controllers, voice-activated controllers, and the like.

Figure 11:
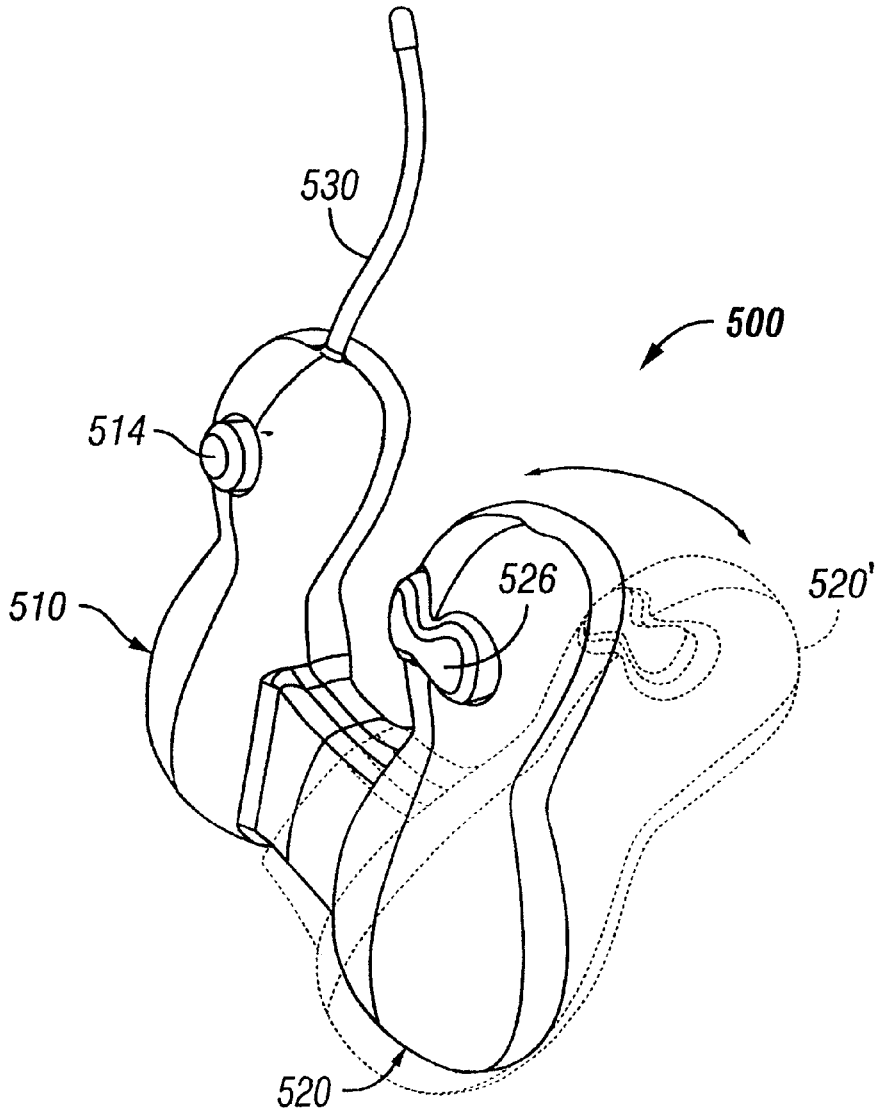
FIG. 11 is a front perspective view of an embodiment of a remote controller for use with the present invention.
Figure 12:
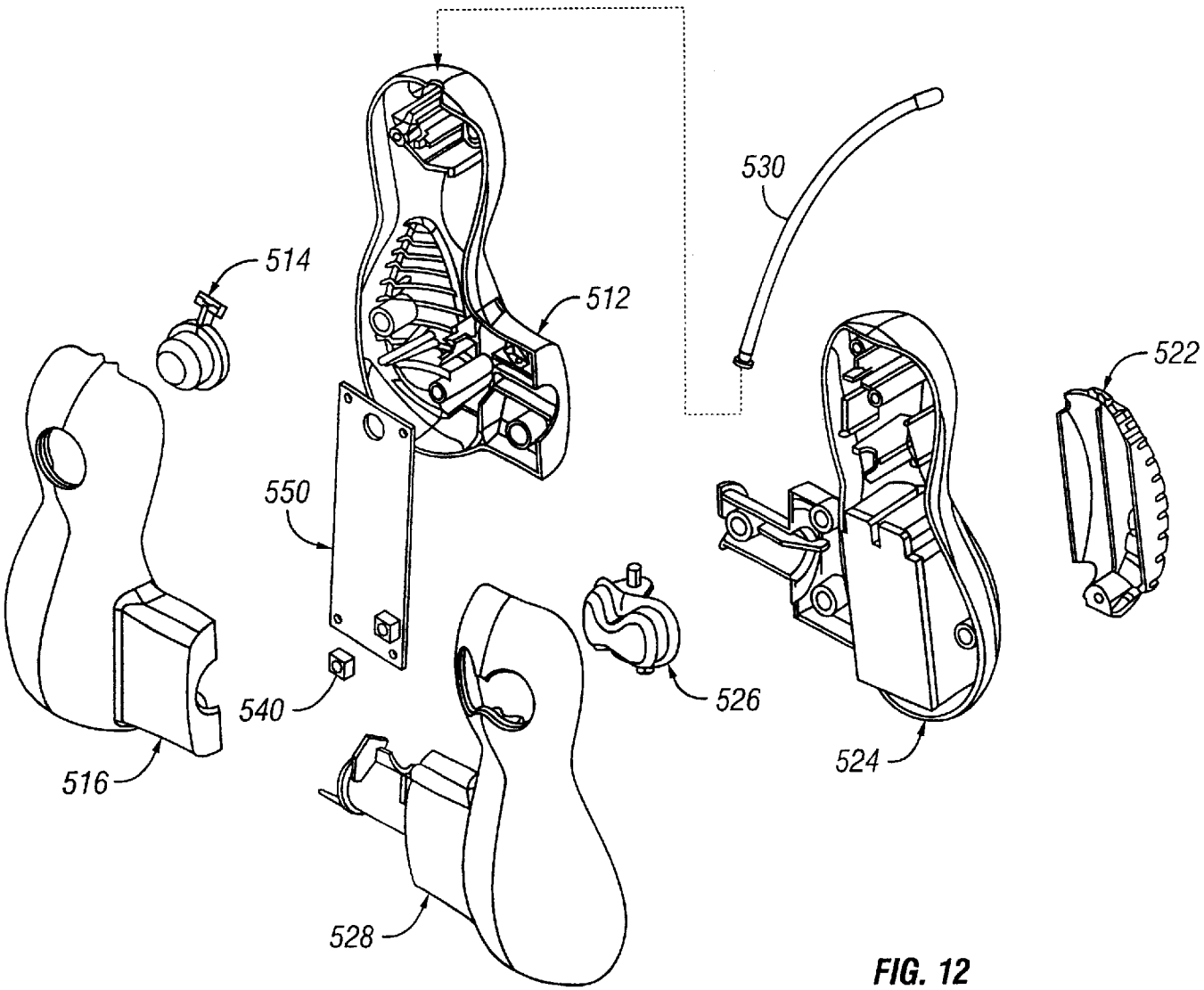
FIG. 12 is an exploded view of the remote controller of FIG. 8.

A preferred embodiment of a remote controller 500 for use with the present invention is shown in FIGS. 11 and 12. The remote controller 500 preferably comprises a multi-part housing having left hand and right hand portions 510, 520. Each of the left hand and right hand portions 510, 520 is preferably formed from a top housing 516, 528 and a bottom housing 512, 524. A left button 514 is preferably mounted in the left hand portion 510, and a right rocker switch 526 is mounted in the right hand portion 520.

An antenna 530 may be included to receive and/or transmit signals to and/or from the remote controller 500.

As illustrated in FIG. 11, the left and right hand portions 510, 520 are preferably pivotable with respect to each other. A switch 540 is preferably mounted within the remote controller 500. The switch 540 is preferably responsive to the pivoting of the left and right hand portions 510, 520.

The remote controller 500 also preferably includes circuitry 550 to, for example, process inputs from the switch 540, the left button 514, and the right rocker switch 526, and to transmit and receive signals to and from the toy vehicle 10. Preferably, the activation of the switch 540, the left button 514, and the right rocker switch 526 individually or cooperatively control the operation of the toy vehicle 10 and the flipping mechanism 400.

In a preferred embodiment, the remote controller 500 is designed such that pressing the left button 514 activates the toy vehicle's 10 drive motor 310 to drive the toy vehicle in a forward direction. Pressing the right rocker switch 526 activates the motor in the steering assembly 170 to steer the toy vehicle 10. Pivoting the left and right hand portions 510 and 520 with respect to each other activates the switch 540, reverses the drive of the drive motor 310 and accordingly activates the flipping mechanism 400.

It will be understood that the remote controller 500 can be formed of a variety materials and may be modified to include additional switches and/or buttons. It will be further understood that a variety of other types of controllers may be used to control the operation of the toy vehicle of the present invention including the activation of the flipping mechanism.

One of ordinary skill will appreciate that although the embodiments discussed above refer to actuation of the flipping mechanism 400 when the toy vehicle 10 is driven in reverse, other modes of operation could be used. For example, the flipping mechanism could be actuated upon driving the vehicle in a forward direction, or by activating a switch on a remote controller, or by having the toy vehicle 10 pass over a beacon which is detected by circuitry on the toy vehicle 10.

Although the invention is describes herein in terms of the preferred, four-wheeled embodiments, the present invention could also comprise a vehicle having three wheels, or more than four wheels.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A toy vehicle comprising:

a vehicle body having a front portion and a rear portion and a longitudinal axis extending through the front and rear portions;

at least one rear wheel coupled with the rear portion and located on the vehicle so as to at least partially support the rear portion;

a first electric motor drivingly coupled with the at least one rear wheel;

at least one front wheel coupled with the front portion and located on the vehicle so as to at least partially support the front portion;

an electrically operated steering actuator mounted on the front portion and drivingly coupled to the at least one front wheel to rotate the at least one wheel to steer the toy vehicle; and, a spring-loaded flipping mechanism rotatably coupling the front and rear portions together so as to selectively flip the front portion of the vehicle body at least 360° with respect to the rear portion of the vehicle body about the longitudinal axis.

2. The toy vehicle according to claim 1, wherein the spring loaded flipping mechanism further comprises a triggering mechanism, a rotational drive mechanism and a spring protection mechanism.

3. The toy vehicle according to claim 2, wherein the rotational drive mechanism comprises;

a main shaft extending through both the front and rear portions of the toy vehicle along the longitudinal axis;

a main spring operably connected between the main shaft and one of the front and rear portions;

a winding gear fixedly connected to the main shaft;

a shaft disk fixedly connected to the main shaft and in releasable engagement with the triggering mechanism;

wherein upon disengagement of the triggering mechanism with the shaft disk, the shaft disk and the main shaft are released to rotate the front portion with respect to the rear portion of the toy vehicle around the main shaft under the action of the main spring.

4. The toy vehicle according to claim 3, wherein the triggering mechanism further comprises:

a stopper member releasably engaging the shaft disk of the rotational drive mechanism, a first swing door engaging the stopper member;

a slide plate mounted for linear motion and engaging the first swing door;

a trigger which engages a slide plate once per full rotation of the trigger;

wherein engagement of the trigger with the slide plate causes linear motion of the slide plate, the linear motion of the slide plate in turn causing rotation of the first swing door, the rotation of the first swing door in turn moving the first swing door out of engagement with the stopper member, allowing the stopper member to move out of engagement with the shaft disk, in turn allowing the rotational drive mechanism to rotate the front portion of the vehicle body with respect to the rear portion of the vehicle.

5. The toy vehicle according to claim 4, wherein following one 360° revolution of the front portion relative to the rear portion, the swing door re-engages the stopper member, moving the stopper member into engagement with the shaft disk preventing further rotation of the front portion relative to the rear portion.

6. The toy vehicle according to claim 4, wherein the triggering mechanism is coupled to the at least one rear wheel, and wherein rotation of the at least one rear wheel corresponding to rearward motion of the toy vehicle triggers operation of the rotational drive mechanism to rotate the front portion of the vehicle relative to the rear portion.

7. The toy vehicle according to claim 3, wherein the spring protection mechanism comprises;

a crown gear in geared engagement with the winding gear;

a cam groove disposed on a first face of the crown gear;

a swinging door engaged with the cam groove by a pin integral to the swinging door, the pin being inserted into the cam groove;

wherein when the crown gear has rotated a predetermined amount, the swinging door is rotated into engagement with the stopper member of the triggering mechanism, preventing further operation of the rotational drive mechanism to rotate the front portion of the toy vehicle with respect to the rear portion of the vehicle by action of the triggering mechanism.

8. The toy vehicle according to claim 7, wherein the spring protection mechanism further comprises:

a cam surface disposed on the first face of the crown gear;

an over-wind protection arm biased into engagement with the cam surface;

wherein when the cam gear has rotated a predetermined amount by a user winding the main spring of the toy vehicle, the over-wind protection arm is rotated into engagement with the shaft disk, preventing further winding of the main spring of the toy vehicle.

9. The toy vehicle according to claim 1 in combination with a remote control device configured to selectively control movement of the toy vehicle and activation of the rotational drive mechanism.

10. The toy vehicle according to claim 9, wherein the remote control device comprises a handheld remote controller having a multi-part housing, and wherein at least two of the housing parts are pivotable with respect to each other in order to control an operation of the toy vehicle.

* * * * *